United States Patent [19]

Choi et al.

[11] Patent Number: 4,615,791

[45] Date of Patent: Oct. 7, 1986

[54] VISBREAKING PROCESS

[75] Inventors: Byung C. Choi; Benjamin Gross, both of Cherry Hill; Madhava Malladi, W. Deptford, all of N.J.

[73] Assignee: Mobil Oil Corporation, New York, N.Y.

[21] Appl. No.: 771,739

[22] Filed: Sep. 3, 1985

Related U.S. Application Data

[63] Continuation-in-part of Ser. No. 688,083, Dec. 31, 1984, abandoned, which is a continuation-in-part of Ser. No. 519,625, Aug. 1, 1983, abandoned, and a continuation-in-part of Ser. No. 519,625.

[30] Foreign Application Priority Data

Jul. 26, 1984 [EP] European Pat. Off. ..... 84/305082.4

[51] Int. Cl.[4] ..... C10G 47/32

[52] U.S. Cl. ..... 208/107; 208/56; 208/106

[58] Field of Search ..... 208/107, 106, 56

[56] References Cited

U.S. PATENT DOCUMENTS

| | | | |
|---|---|---|---|
| 2,900,327 | 8/1959 | Beuther | 208/106 |
| 2,953,513 | 9/1960 | Langer | 208/56 |
| 4,292,168 | 9/1981 | Derbyshire et al. | 258/107 |
| 4,363,716 | 12/1982 | Greene et al. | 208/107 |
| 4,389,302 | 6/1983 | Garvin et al. | 208/86 |
| 4,389,303 | 6/1983 | Simo et al. | 208/107 |
| 4,405,442 | 9/1983 | Deschamps et al. | 208/107 |
| 4,434,045 | 2/1984 | Vernon et al. | 208/107 |
| 4,469,587 | 9/1984 | Tailleur | 208/61 |

FOREIGN PATENT DOCUMENTS

| | | | |
|---|---|---|---|
| 7802023 | 1/1978 | France | 208/10 |

*Primary Examiner*—John Doll
*Assistant Examiner*—Anthony McFarlane
*Attorney, Agent, or Firm*—Alexander J. McKillop; Michael G. Gilman; Malcolm D. Keen

[57] ABSTRACT

Heavy petroleum oils such as resids are subjected to visbreaking in the presence of a hydroaromatic hydrogen donor solvent having an aromatic and alpha-to-aromatic proton content each of at least 20 percent of the total solvent hydrogen. The amount of donor solvent is from 0.1 to 50, preferably 0.1 to 20, weight percent of the heavy oil feed. The visbreaking may be carried out at relatively high severities as the use of the donor solvent reduces coke formation as well as producing a product of reduced viscosity, pour point and sedimentation characteristics. Reaction severity is usually in the range of 250 to 1500 seconds ERT at 800° F. (427° C.) but may range up to 15000 seconds ERT. Suitable solvents may be obtained from catalytic cracking process, for example, FCC cycle oils, slurry oils and main column bottoms.

35 Claims, 1 Drawing Figure

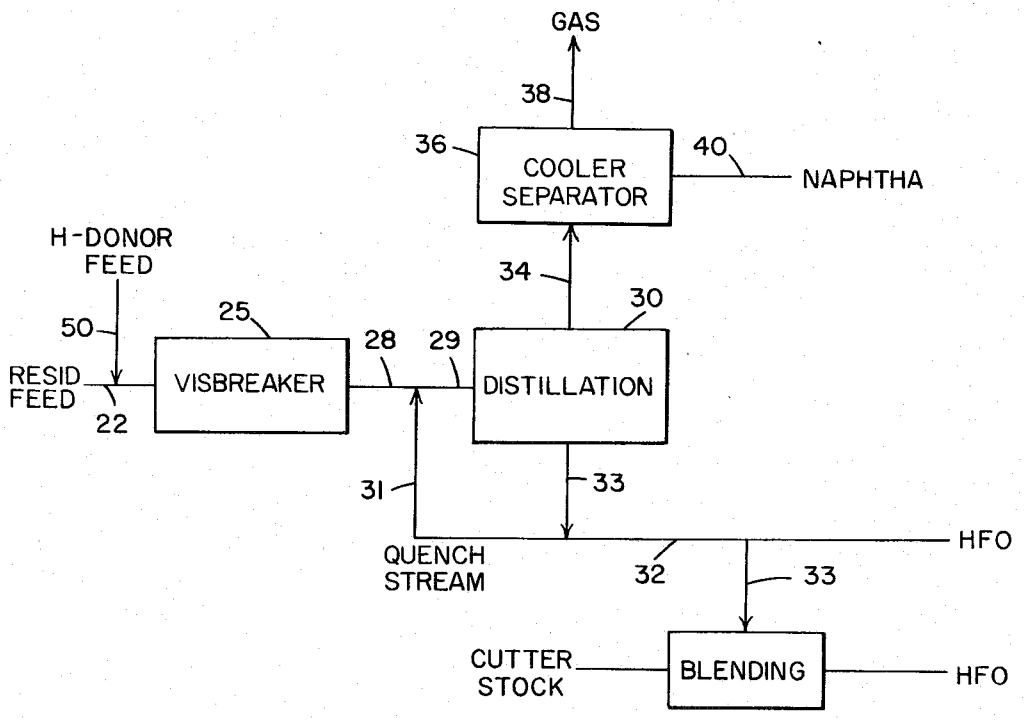
GAS
38
COOLER SEPARATOR
36
40
NAPHTHA
34
30
DISTILLATION
29
28
VISBREAKER
25
H-DONOR FEED
50
RESID FEED
22
33
31
QUENCH STREAM
HFO
32
33
BLENDING
HFO
CUTTER STOCK

VISBREAKING PROCESS

CROSS REFERENCE TO RELATED APPLICATIONS

This application is a continuation-in-part of application Ser. No. 688,083, filed Dec. 31, 1984 which, in turn, was a continuation-in-part of Ser. No. 519,625, filed Aug. 1, 1983, both now abandoned. This application is also a continuation-in-part of Ser. No. 519,625 filed Aug. 1, 1983.

This application claims priority under 35 USC 119 for subject matter disclosed in European Patent Application No. 84 305082.4, filed July 26, 1984 for subject matter not disclosed in U.S. application Ser. No. 519,625.

The contents of U.S. application Ser. Nos. 519,625 and 688,083 are incorporated in this application by reference.

FIELD OF THE INVENTION

This invention relates to a visbreaking process and more particularly, to a visbreaking process which is carried out in the presence of a hydrogen donor solvent.

BACKGROUND OF THE INVENTION

Visbreaking, or viscosity breaking, is a well known petroleum refining process in which heavy oils including residual fractions or reduced crudes are pyrolyzed, or cracked, under comparatively mild conditions to provide products having lower viscosities, thus reducing the amounts of less viscous and more valuable blending oils required to make the residual stocks useful as fuel oils. The visbreaker feedstock usually consists of one or more refinery streams derived from sources such as atmospheric residuum, vacuum residuum, furfural extract, propane-deasphalted tar and catalytic cracker bottoms. Most of these feedstock components, except the heavy aromatic oils, behave independently in the visbreaking operation. Consequently, the severity of the operation for a mixed feed is limited greatly by the least desirable (highest coke-forming) components. In a typical visbreaking process, the crude or resid feed is passed through a heater and heated to about 425° to about 525° C. at about 450 to about 7000 kPa. Light gas-oil may be recycled from the product fractionator to quench the visbreaker reactor effluent to about 260° to about 370° C. Cracked products from the reaction are flash distilled with the vapor overhead being fractionated into a light distillate overhead product, for example gasoline and light gas-oil bottoms, and the liquid bottoms are vacuum fractionated into heavy gas-oil distillate and residual tar. Examples of such visbreaking methods are described in Beuther et al, "Thermal Visbreaking of Heavy Residues," *The Oil and Gas Journal,* 57:46, Nov. 9, 1959, pp. 151–157; Rhoe et al, "Visbreaking: A Flexible Process," *Hydrocarbon Processing, January* 1979, pp. 131–136; and U.S. Pat. No. 4,233,138.

Various visbreaking processes have been proposed in which residual oils are added at the visbreaking stage with or without added hydrogen or hydrogen-donors. For example, U.S. Pat. No. 3,691,058 describes the production of single ring aromatic hydrocarbons (70°–220° C.) by hydrocracking a heavy hydrocarbon feed (565° C.−) and recycling 32°–70° C. and 220° C.+ product fractions to extinction. This is integrated with visbreaking of residua in the presence of 1 to 28 weight % free radical acceptor at 370°–480° C. in the presence or absence of hydrogen (to enhance residua depolymerization). U.S. Pat. No. 4,067,757 describes a process which involves passing a resid at temperatures from 400°–540° C. up through a bed of inert solids (packed bed reactor) either in the absence of hydrogen or the presence of specific quantities of hydrogen relative to the resid to enhance production of middle distillate. U.S. Pat. No. 4,363,716 discloses an upgrading process for heavy oils using a hydrogen donor solvent which is subjected to hydroprocessing in a recycle sequence. The solvent is used in an amount of at least 25 percent with respect to the feedstock.

U.S. Pat. No. 2,953,513 discloses a hydrogen donor diluent cracking process using hydrogen-donors produced by the partial hydrogenation of certain distillate thermal and catalytic tars, boiling above 370° C., containing a minimum of 40 weight % aromatics. The donors have hydrogen:carbon ratios of 0.7–1.6. The resid feed is mixed with 9–83 volume % of the hydrogen donor and thermally cracked at 427°–482° C. to produce low boiling products. U.S. Pat. No. 4,090,947 describes a thermal cracking process (425°–540° C.) for converting resids to lighter products in the presence of 10–500 volume percent of a hydrogen-donor produced by hydrotreating coker gas oil (345°–480° C.) alone or blended with gas oil produced in the thermal cracker.

A number of proposals have been made for upgrading resids by thermal cracking processes which are operated with hydrogen, either alone or with hydrogen transfer solvents. For example, U.S. Pat. No. 4,292,168 discloses the upgrading of heavy hydrocarbon oils without substantial formation of char by heating the oil with hydrogen and a hydrogen transfer solvent without a catalyst at temperatures of about 320° to 500° C. and at elevated pressure for a time of about 3 to 30 minutes; examples of hydrogen-donor transfer solvents used in this process include pyrene, fluoranthene, anthracene and benzanthracene. U.S. Pat. No. 4,389,303 discloses a process for converting high boiling crudes with high resid contents by carrying out visbreaking, e.g. at temperatures from 380° to 480° C. in the presence of hydrogen as well as a donor solvent. These processes which use free hydrogen have the disadvantage, however, of being relatively expensive both in capital outlay (since pressure vessels and enlarged gas plants are necessary) and operating costs (since hydrogen is expensive). This is so, regardless of whether the hydrogen is contacted directly with the feedstock or used to regenerate the donor solvent. It would therefore be desirable to upgrade resids and other heavy oils without the need for free hydrogen.

Other processes for thermally upgrading heavy oils have been described, for example, in U.S. Pat. Nos. 4,428,824 and 4,389,302. The process described in U.S. Pat. No. 4,428,824 subjects a deasphalted oil to visbreaking, and subsequently reblends it with the asphaltic fraction to produce a product of low viscosity and pour point. This process reduces the amount of cutter stock required to make relatively low viscosity products. The reduction in cutter stock requirement is achieved by minimizing coke formation in the visbreaker, by excluding the worst coke formers, permitting more severe operation of the visbreaker. The process described in U.S. Pat. No. 4,389,302 subjects a heavy oil to sequential separation, visbreaking and separation steps, using an aromatic diluent such as catalytic cracker recycle oil in the visbreaking step. This diluent is used, however, merely to increase the fluidity of the heavy oil which is relatively high in viscosity after the initial separation step in which the lighter components are removed.

These processes have other disadvantages such as the need for solvent deasphalting or separation units but, in particular, they fail to achieve one necessary objective in any heavy oil upgrading step, which is to increase the hydrogen:carbon ratio of the oil without doing this wastefully by simply rejecting carbon as a more refractory resid. Obviously, if hydrogen can be added to the feed without the disadvantages of using molecular hydrogen, a much more economical upgrading process will be at hand.

SUMMARY OF THE INVENTION

We have now found that certain readily available petroleum refinery process streams may be successfully used as hydrogen donor solvents in heavy oil visbreaking processes without the necessity for using free hydrogen, either in the visbreaking operation itself or for regenerating the solvent (because these solvents are cheap and readily available, they may be used on a once-through basis, without the need for regeneration). Generally, the donor visbreaking processes according to the present invention may be operated at low severities, for example, from 250 to 1500 ERT seconds at 800° F. (427° C.), although higher severity operation may also be used.

The hydrogen donor solvents which are used in the present process are hydroaromatic solvents which are characterized by a particular hydrogen content and proton distribution. Although they are relatively hydrogen-deficient materials they function effectively as hydrogen donors in the present process. In these materials, the content of aromatic hydrogen and alpha-to-aromatic hydrogen is each at least 20 percent of the total hydrogen content of the solvent, with the aromatic hydrogen content being at least 2.0 weight percent of the solvent and the alpha-to-aromatic hydrogen at least 1.9 weight percent of the solvent.

These solvents may be used in relatively small amounts relative to the heavy oil feed. Generally, the amount of solvent will not exceed 50 weight percent of the oil, and more commonly will be in the range of 0.1 to 20 weight percent.

In one specific form, the donor visbreaking process will comprise visbreaking the heavy oil feed at an equivalent reaction time (ERT) at 800° F. (427° C.) up to 800 seconds, in the absence of added free hydrogen, and in the presence of the aromatic hydrogen donor solvent having an aromatic and alpha-to-aromatic proton content of at least 20 percent each of the total hydrogen content of the donor.

In another embodiment, the severity is from 250 to 1500 ERT seconds at 800° F. (427° C.), with the aromatic and alpha-to-aromatic protons constituting at least 2.0 and at least 1.9 weight percent, respectively, of the solvent. The amount of the solvent is held at 0.1 to 50 weight percent of the feed.

In another embodiment, the heavy oil is subjected to thermal cracking (ERT at 800° F. (427° C.) is 1500 to 15000 seconds), using a non-hydrotreated solvent of the above proton distribution and content, the solvent in this case being derived from a thermal or fluidized catalytic cracking process.

The present process enables heavy petroleum feed stocks to be visbroken or thermally cracked at high severities to provide fuel oil and other products of improved viscosity and pour point. In addition, the need for cutter stock to meet fuel oil viscosity specifications is substantially reduced and, in favorable cases, may be eliminated. The products are also notable for their improved low sedimentation characteristics.

THE DRAWINGS

The single FIGURE of the accompanying drawings shows a simplified flow diagram of a visbreaking process using a donor solvent.

DETAILED DESCRIPTION

Feedstock

The heavy oil feeds used in the present upgrading process may be a single refinery stream or a mixture of refinery streams derived from various sources. The present process is suitable for upgrading a wide variety of heavy liquid hydrocarbon oils in which at least 75 weight percent of the components boil over 370° C. Included in this class of feeds are residual fractions obtained by catalytic cracking of gas oils, solvent extracts obtained during the processing of lube oil stocks, asphalt precipitates obtained from deasphalting operations, high boiling bottoms or resids obtained during vacuum distillation of petroleum oils, tar sand bitumen feedstocks, and the like. These oils may contain heteroatom impurities such as nitrogen or sulfur as well as having relatively high metal contents.

Donor Solvent

In the present process, the feed is subjected to visbreaking or thermal cracking with a hydrogen donor solvent of particular, defined characteristics. These solvents may be characterized as thermally stable, polycyclic, aromatic/hydroaromatic distillate materials, which result from one or more petroleum refining operations. These hydrogen-donor solvents nominally have average boiling points in the range of 200° to 500° C., and a density of about 0.85 to 1.1 g/cc, approximately 450° to 950° F., with an API gravity of below 20°.

The hydrogen-donor solvent used in the present process are characterized by their particular proportions of aromatic, naphthenic and paraffinic moieties and the type and quantity of hydrogen associated with them. A high content of aromatic and naphthenic structures together with a high content of alpha hydrogen provide superior hydrogen-donor materials which may be used in the present process. These solvents may, as previously stated, be characterized as hydro-aromatic solvents. In spite of their relatively low content of hydrogen, they function effectively as hydrogen donors without the need for hydrogenation.

The hydrogen transfer ability of the donor materials can be expressed in terms of specific types of hydrogen content. The aromatic protons ($H_{AR}$) are to constitute at least 20, and preferably 20 to 50, percent of the total hydrogen content of the solvent and the protons which are in the alpha position to an aromatic ring ($H_{alpha}$) are also to constitute at least 20 and preferably 20 to 50, percent of the total hydrogen content. In addition, these two types of proton should make up at least 2.0 and 1.9 weight percent, respectively, of the solvent, especially for operation at higher severities, e.g. from 800 to 1500 seconds ERT at 800° F. or higher, e.g. up to 15000 ERT. The aromatic protons are believed to be necessary for their strong solvency power and the alpha-to-aromatic ($H_{alpha}$) protons for their potential as labile, donatable hydrogen. Although the protons which are in the alpha-position in completely aromatic compounds are not labile (and therefore not donatable), for example, the alpha protons in toluene, the use of hydroaromatic solvents as described below will enable sufficient donatable alpha protons to be obtained by suitable selection of process streams. Because the refinery process streams which are used are invariably mixtures, the selection is to be made by reference to the proton analysis of the mixture.

The $H_{Ar}$ protons are attached directly to aromatic rings and are a measure of aromaticity of a material. $H_{alpha}$ protons are attached to non-aromatic carbon atoms themselves attached directly to an aromatic ring structure, for example alkyl groups and naphthenic ring structures. $H_{beta}$ protons are attached to carbon atoms which are in a second position away from an aromatic ring, and $H_{gamma}$ protons are attached to carbon atoms which are in a third position or more away from an aromatic ring structure. This can be illustrated by the following:

(1)

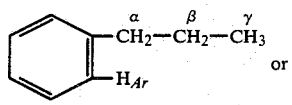

or (2)

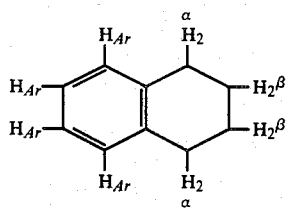

(3)

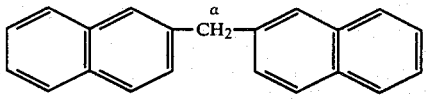

(4)

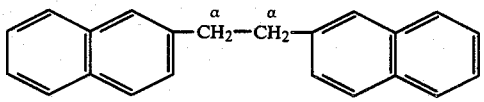

(5)

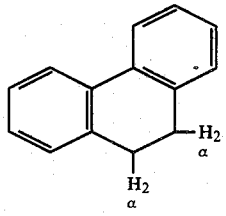

(6)

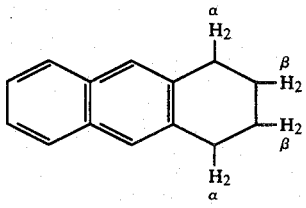

-continued (7)

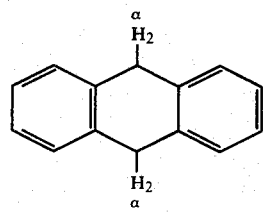

(8)

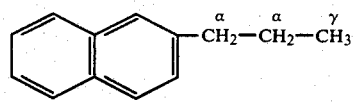

As mentioned above, alpha hydrogens in wholly aromatic compounds may not be donatable, for example, the alpha hydrogen in toluene or in compound (8) above, which is not a hydro-aromatic solvent.

The proton analysis of a compound or a mixture may be determined by nuclear magnetic resonance (NMR) spectral analysis. The aromatic, alpha, beta and gamma protons appear in four bands in the NMR spectrum at the following frequencies and chemical shifts:

TABLE 1

| | Proton NMR | | | |
|---|---|---|---|---|
| | $H_{alpha}$ | $H_{beta}$ | $H_{gamma}$ | $H_{Ar}$ |
| Freq (Hz) | 0–60 | 60–100 | 120–200 | 360–560 |
| Shift (ppm) | 0–1 | 1.0–1.67 | 2.0–3.33 | 6.0–9.33 |

The resonant frequencies quoted are for a 60 MHz instrument, at other field strengths the resonant frequencies will be different although the chemical shifts will remain constant.

As mentioned above, hydrogen-donor materials employed in the present process have a hydrogen content distribution such that the $H_{Ar}$ proton content is at least 20 percent, preferably from 20 to 50 percent, and the $H_{alpha}$ proton content is at least 20 percent, preferably from 20 to 50 percent. For example, in H-donor streams containing 9.5 weight percent total hydrogen, the $H_{Ar}$ and $H_{alpha}$ content should be at least 1.9 weight percent each (20% of total hydrogen content). Also, the $H_{Ar}$ content should be at least 2.0 weight percent of the solvent and the $H_{alpha}$ content at least 1.9 weight percent, to preclude the presence of large amounts of coke-forming, condensed ring aromatics.

Hydrogen donor solvents having the appropriate proton content and distribution may be obtained from various petroleum refinery streams, especially from catalytic cracking or hydrocracking operations. They may also be obtained from other processes such as coal liquefaction processes, e.g. solvent refined coal processes (SRC). Catalytic cracking operations, either of the fluid (FCC) or moving bed (Thermofor Catalytic Cracking—TCC) types are particularly suitable sources for donor solvents. Catalytic cracking streams such as cyclc oils including heavy cycle oil (HCO) and light cycle oil (LCO), main column bottoms (MCB) and slurry oils, e.g. clarified slurry oil (CSO) may be used if they have the appropriate proton content and distribution. The proton content and distribution of these and other streams will depend upon the source of the stream and the processing conditions used in its production; for example, the composition of catalytic cracking streams will vary according to crude source as well as conditions such as temperature, pressure, catalyst-to-oil ratio, space velocity and type of catalyst. Generally, increasing the severity of the cracking operation will result in increased aromatic and alpha proton content in the process streams, with corresponding reductions in the less desirable non-alpha protons.

The proton contents and distributions of various, exemplary process streams are shown below in Table 2, which gives the proton distributions and contents in various refinery streams and one coal liquids stream. Values reported in ( ) are for proton content as a weight percentage of the solvent, other values show distribution as a percentage of the total hydrogen content in the solvent.

TABLE 2

| | Proton Analysis H-Donors | | | | | | |
|---|---|---|---|---|---|---|---|
| | $H_{alpha}$ | | $H_{Ar}$ | | $H_{Other}$ | | H Total |
| | % H | (% Solv) | % H | (% Solv) | % H | (% Solv) | % Solv |
| FCC/LCO | | | | | | | |
| No. 1 | 22.2 | (2.07) | 20.0 | (1.87) | 57.8 | (5.40) | 9.34 |
| No. 2 | 34.1 | (3.18) | 29.1 | (2.71) | 36.8 | (3.43) | 9.32 |
| No. 3 | 34.3 | (3.19) | 30.2 | (2.81) | 35.5 | (3.30) | 9.30 |
| FCC/CSO | | | | | | | |
| No. 1 | 34.0 | (2.43) | 33.0 | (2.36) | 33.0 | (2.36) | 7.15 |
| No. 2 | 30.0 | (2.15) | 35.0 | (2.51) | 35.0 | (2.36) | 7.17 |
| No. 3 | 19.4 | (1.39) | 5.0 | (0.03) | 65.0 | (33.3) | 7.16 |
| FCC/MCB | | | | | | | |
| No. 1 | 36.0 | (2.65) | 32.0 | (2.36) | 32.0 | (2.36) | 7.36 |
| No. 2 | 36.4 | (2.68) | 44.8 | (3.30) | 18.8 | (1.38) | 7.36 |
| No. 3 | 18.5 | (1.36) | 17.2 | (1.26) | 64.3 | (4.73) | 7.35 |
| No. 4 | 18.1 | (1.33) | 14.2 | (1.04) | 67.7 | (4.96) | 7.35 |
| TCC/Syntower Bottoms | | | | | | | |
| No. 1 | 29.8 | (2.78) | 41.4 | (3.86) | 28.8 | (2.69) | 9.33 |
| No. 2 | 18.2 | (1.70) | 23.0 | (2.15) | 58.8 | (5.49) | 9.34 |
| No. 3 | 16.3 | (1.52) | 15.6 | (1.45) | 68.1 | (6.35) | 9.32 |
| TCC Distillate | | | | | | | |
| No. 1 | 21.5 | (2.39) | 20.1 | (2.23) | 58.4 | (6.49) | 11.12 |
| No. 2 | 20 | (2.07) | 22 | (2.28) | 58 | (6.00) | 10.35 |
| No. 3 | 6.9 | (0.89) | 8 | (1.03) | 85.1 | (10.98) | 12.90 |
| SRC Recycle Oil | 27.1 | — | 46.3 | — | 21.6 | — | — |

All of the values reported above are for non-hydrotreated materials.

From the data given in Table 2 above, it will be seen that hydrocarbons having the same general process derivation may or may not have the desired proton distribution. For example, all the FCC/LCO, together with FCC/MCB Nos. 1 and 2 and FCC/CSO Nos. 1 and 2 have the desired proton distribution while FCC/MCB Nos. 3 and 4 and FCC/CSO 3 do not. Furthermore, although it is preferred that the highly aromatic hydrogen donor component is derived from petroleum, it will be noted that the SRC recycle solvent closely resembles FCC/MCB Nos. 1 and 2.

Because the absolute content of the alpha and aromatic protons in the solvent is also significant, it should be noted that even among the acceptable donors, those with the higher absolute contents of the appropriate protons will be preferred, e.g. FCC/LCO Nos. 2 and 3 may be expected to perform better than No. 1.

The hydrogen donor solvent may be provided by various petroleum refinery streams of various origins such as fluidized catalytic cracker (FCC) "main column" bottoms, FCC "light cycle oil," and thermofor catalytic cracker (TCC) "syntower" bottoms, all of which contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, tetralin and dihydronaphthalene, for example. Such refractory petroleum materials are resistant to conversion to lighter (lower molecular weight) products by conventional non-hydrogenative procedures. Typically, these petroleum refinery residual and recycle fractions are hydrocarbonaceous mixtures having an average carbon to hydrogen ratio above about 1:1, and an average boiling point above about 230° C. (about 450° F.).

As FCC main column bottoms refinery fraction of the appropriate proton content and distribution is a highly preferred hydrogen donor solvent for use in the process of the invention. A typical FCC main column bottoms (or FCC clarified slurry oil (CSO)) contains a mixture of constituents as represented in the mass spectrometric analysis given in Table 3 below:

TABLE 3

| | CB/CSO Analysis | | |
|---|---|---|---|
| Compounds | Aromatics | Naphthenic/ Aromatics | Labile $H_2$ % |
| Alkyl-Benzene | 0. | — | 0.00 |
| Naphthene-Benzenes | — | 1.0 | 0.03 |
| Dinapthene-Benzenes | — | 3.7 | 0.16 |
| Naphthalenes | 0.1 | — | 0.00 |
| Acenaphthenes (biphenyls) | — | 7.4 | 0.08 |
| Fluorenes | — | 10.1 | 0.11 |
| Phenanthrenes | 13.1 | — | — |
| Naphthene-phenanthrenes | — | 11.0 | 0.18 |
| Pyrenes, fluoranthenes | 20.5 | — | 0.00 |
| Chrysenes | 10.4 | — | 0.00 |
| Benzofluoranthenes | 6.9 | — | 0.00 |
| Perylenes | 5.2 | — | 0.00 |
| Benzothiophenes | 2.4 | — | — |
| Dibenzothiophenes | 2.4 | — | — |
| Naphthobenzothiophenes | — | 2.4 | — |
| Total | 64.4 | 35.6 | 0.60 |

A typical FCC main column bottoms or clarified slurry oil has the elemental analysis and properties set out in Table 4 below:

TABLE 4

| FCC MCB/CSO Elemental Analysis, Weight % | |
|---|---|
| C | 89.93 |
| H | 7.35 |
| O | 0.99 |
| N | 0.44 |
| S | 1.09 |
| Total | 99.80 |
| Pour Point, °C.: 10 | |
| CCR, %: 9.96 | |
| Distillation: | |
| IBP, °C.: | 254 |
| 5%, °C.: | 338 |
| 95%, °C.: | 485 |

Another preferred hydrogen-donor material is a light cycle oil (LCO) taken from the main tower fractionator of a FCC operation of the riser type in which the LCO results from a distillation cut point not substantially above about 370° C.

A typical FCC LCO has the analysis and properties set out in Table 5.

TABLE 5

| FCC LCO Analysis | FCC LCO |
|---|---|
| Boiling Point Distribution, weight % | |
| 215° C. | 4.8 |
| 215–343° C. | 87.9 |
| 343–427° C. | 7.3 |
| 427–538° C. | — |
| 538° C.+ | — |
| H, weight % | 10.64 |
| S, weight % | 1.01 |
| N, weight % | 0.24 |
| Ni + V, PPM by weight | — |
| CCR, weight % | — |
| Paraffins, weight % | 12.7 |
| Mononaphthenes | 11.7 |
| Polynaphthenes | 12.8 |
| Monoaromatics | 24.7 |
| Diaromatics | 21.7 |
| Polyaromatics | 14.3 |
| Aromatic sulfur type | 2.1 |
| Total hydrogen, weight % | 9.0–9.5 |

More complete descriptions of the production of FCC fractions such as MCB and LCO are given, for example, in U.S. Pat. Nos. 3,725,240 and 4,302,323.

A process closely related to FCC is TCC, or Thermofor catalytic cracking. Thermofor catalytic cracking is a moving bed catalytic cracking process and, like FCC, it operates without addition of hydrogen, at relatively low pressure, with frequent regeneration of catalyst. The products of Thermofor catalytic cracking will have hydrogen contents and distribution very similar to those obtained as a result of FCC. Accordingly, light cycle oils obtained as product streams from a TCC process, or main column bottoms streams obtained as a result of a TCC process, are also suitable for use in the present process provided that they have the requisite proton content and distribution.

Other potential sources for hydrogen donor solvents which may be used in the present process are the heavy fractions associated with lubricating oils, the aromatic extracts from lube plants, e.g. Udex or Sulfolane extracts which are highly aromatic in nature but which may be subjected to hydrogenation to produce a hydroaromatic donor solvent with the desired hydrogen content and distribution. Solvents may also be obtained by the catalytic dewaxing of fuels and other refinery streams. The aromatic tars produced in olefin crackers may also provide suitable donor solvents.

The donor solvents may also be obtained from non-petroleum sources, for example, the aromatic liquids produced by various coal liquefaction processes. A particularly preferred class of hydrogen-donor solvents are those which are recovered from liquefied coal extract, hydrogenated and recycled back to the coal liquefaction step.

Normally it will be most economic to use whatever solvents can be found in a refinery of elsewhere, without hydrotreating, for use in the present process. It is also possible, although usually more expensive, to take a hydrogen-donor solvent which is not entirely satisfactory, and subject it to hydrogenation treatment to increase its hydrogen content, to alter its hydrogen distribution, or both. If such a charge stock is very highly aromatic, a substantial amount of hydrogen must be added to make the hydrogen-donor solvent suitable for use in the present process. Excessive hydrogenation should be avoided, however, since it is not beneficial to saturate all of the aromatic rings in the hydrocarbon solvent so that the solvent loses its properties as a hydroaromatic compound.

VISBREAKING CONDITIONS

In most hydrocarbon processes, there is a tradeoff between reaction temperature and residence time of reactants. Because visbreaking is a well-known and widely practiced process, however, correlations have been developed so that it is possible to express precisely the severity of the visbreaking process. An expression of the "severity" of a particular visbreaking operation does not mean that a certain degree of conversion can be predicted or obtained or that a certain amount of coke or sediment will be formed; rather it means that it is possible to predict that if all other reaction parameters are unchanged (e.g., feed composition, reactor pressure) except for the temperature and residence time in the reactor, two operations can be compared and it can be determined whether one process is more severe than the other. Equations and tables have been developed for comparing reaction severities. Typical of such presentations is the discussion of "soaking factor" in Petroleum Refinery Engineering—Thermocracking and Decomposition Process—Equation 19–23 and Table 19–18, in Nelson—Modern Refining Technology, Chapter 19. Although that text uses the term "soaking factor", the term "ERT" or "Equivalent Reaction Time" in seconds as measured at 427° C. (800° F.) is used in this specification to express visbreaking severity; numerically, soaking factor is the same as ERT at 427° C.

ERT refers to the severity of the operation, expressed as the equivalent number of seconds of residence time in a reactor operating at 427° C. (800° F.). In very general terms, the reaction rate doubles for every 12° to 13° C. increase in temperature. Thus, 60 seconds of residence time at 427° C. is equivalent to 60 ERT, and increasing the temperature to 456° C. would make the operation five times as severe, i.e. 300 ERT. Expressed in another way, 300 seconds at 427° C. is equivalent to 60 seconds at 456° C., and the same product mix and distribution should be obtained under either set of conditions.

The visbreaking process conditions which may be used can vary widely based on the nature of the heavy oil material, the hydrogen-donor material and other factors. In general, the process is carried out at temperatures ranging from 350° to 485° C., preferably 425° to 455° C., at residence times ranging from 1 to 60 minutes, preferably 7 to 20 minutes. Expressed as ERT, the process of the invention generally operates at an Equivalent Reaction Time at of 250 to 1500 ERT seconds, and preferably 400 to 1200 ERT seconds and more preferably 500 to 800 ERT seconds, at 427° C. In many cases, severity will be up to 800 ERT seconds at 427° C.

The limit of severity is determined primarily by product quality. Visbreaking is an inexpensive process, and once a visbreaker has been installed, it does not cost much more to run it at high severity in order to achieve the maximum viscosity reduction possible with a given feed stock. However, the two limiting factors in the visbreaker operation are the formation of coke (which tends to plug the coil and/or soaking drum used in the visbreaker and also take the product out of specification) and sediment formation in the product. Sediment formation is a complicated phenomenon. As a generalization, it can be stated that, if the composition of an oil is changed enough, the asphaltic materials may no longer dissolve in the product and hence settle out as sediment. The problem becomes worse when cutter stocks or blending stocks of a less aromatic nature are added to the visbreaker product; the asphaltics or other materials that would remain dissolved in the visbreaker product are no longer soluble upon blending the visbreaker product with other, less aromatic materials.

An important aspect of the invention is the improvement of visbreaker performance by optimizing operational severity for heavy oil feedstocks. In general, as severity is increased, increased yields of distillate and gaseous hydrocarbons are obtained with a reduction in the viscosity of the visbroken products so that the amount of cutter oil required for blending to obtain specification—viscosity residual fuel oil is also reduced. At high severities, however, there is an increased tendency to form coke deposits which result in plugged heater tubes and/or the production of unstable fuel oils as measured by sediment formation. The use of the present hydrogen-donors has, however, been found to suppress the formation of sedimentation species and thus permit a higher severity operation than is otherwise possible without adding hydrogen donors, while still producing stable fuel oil. As an example, the visbreaking of a heavy petroleum feed stock conventionally carried out at a severity of 500 ERT seconds may be increased to a higher severity of 800 ERT seconds to obtain a fuel oil product free of sedimenting species. At high severities, the cutter stock requirement is substantially reduced which thus represents a considerable financial saving.

According to a further aspect of the invention, non-hydrotreated solvents derived from thermal and fluidized catalytic cracking processes can also be used with advantage in the thermal cracking of heavy oils at higher severities in order to convert significant quantities of the heavy oil into lighter products.

Thus, the present invention also provides a process for the thermal cracking a heavy oil in which the oil is subjected to an elevated temperature for a period of time corresponding to an equivalent reaction time of 1500 to 15,000 ERT seconds at 427° C., in the presence of from 0.1 to 50 weight %, based on the heavy oil, of a non-hydrotreated solvent derived from a thermal or fluidized catalytic cracking process having a content of $H_{Ar}$ and $H_{alpha}$ hydrogen each of at least 20 percent of the total hydrogen content.

The pressure employed in a visbreaker will usually be sufficient to maintain most of the material in the reactor coil and/or soaker drum in the liquid phase. Normally the pressure is not considered as a control variable, although attempts are made to keep the pressure high enough to maintain most of the material in the visbreaker in the liquid phase. Some vapor formation in the visbreaker is not harmful, and is frequently inevitable because of the production of some light ends in the visbreaking process. Some coil visbreaker units operate with 20–40% vaporization material at the visbreaker coil outlet. Lighter solvents will vaporize more and the vapor will not do much good towards improving the processing of the liquid phase material. Accordingly, liquid phase operation is preferred, but significant amounts of vaporization can be tolerated.

In general, the pressures commonly encountered in visbreakers range from 170 to 10450 kPa, with a vast majority of units operating with pressures of 1480 to 7000 kPa. Such pressures will usually be sufficient to maintain liquid phase conditions and the desired degree of conversion.

VISBREAKER

The visbreaker unit itself may be conventional in form, typically of the coil, i.e. a tubular reactor which is entirely in the heater or drum type or with a combination of coil and drum in order to provide the requisite residence time under the temperature conditions employed. As far as product type and distribution is concerned, it is of no great significance whether the residence time is obtained in a coil, drum, or combination of both. Typical of the coil/drum combinations is the unit disclosed in U.S. Pat. No. 4,247,387.

The present process may suitably be carried out in a refinery unit of the type shown diagrammatically in the accompanying drawing. Referring to the drawing, a viscous hydrocarbon oil feed, typified by a 496° C.+ Arab Heavy resid, is supplied by line 22 to visbreaking heater 25. The feed is blended with hydrogen-donor material supplied through line 50 in an amount 0.1 to 50 weight %, preferably 0.1 to 20 weight %, based on the resid charge, (a weight ratio of hydrogen-donor to resid of 0.001 to 0.5, preferably 0.001 to 0.2). Mild thermal cracking of the resid under visbreaking conditions occurs in visbreaker 25 and produces a visbreaker effluent stream carried by line 28. This stream is cooled by admixture with a quench stream from line 31, and the visbreaker effluent continues through line 29 to distillation column 30 where it is fractionated to obtain $C_5$-gases ($C_3$, $C_4$ and lower) and a $C_5$–135° C. naphtha fraction from the top through line 34. A 220°–370° C. gas oil fraction may be taken off as a bottoms stream through line 33 where portions may be recycled as a quench stream through line 31, recovered as heavy fuel oil 32 or, via line 33, blended with cutter stock to meet fuel oil product specifications.

The overhead fraction removed from the distillation column in line 34 is passed through a cooler separator 36 which is operated under conditions effective to separate the incoming liquid into a $C_5$- off-gas stream 38, mainly $C_3$ or $C_4$ and lower, and a $C_5$–135° C. naphtha fraction which is taken off via line 40. Because of the boiling range and quality of the hydrogen-donor, it can simply be allowed to remain with the bottom fraction and used directly as heavy fuel oil, thus avoiding the need for separation.

Any conventional distillation scheme may be used to process the visbreaker reactor effluent. In conventional visbreaking operations, it is preferred to quench the visbreaker effluent with a quench stream as shown in the drawing, but it is also possible to use heat exchange, fin/fan coolers, or some other conventional means of cooling the visbreaker effluent. However, since there is a risk of coking up the heat exchanger tubes in such an arrangement, the use of a quench stream is preferred.

The light products which are obtained as by-products in the visbreaking process are not particularly desirable for blending with other refinery streams. Usually, the visbroken product will be processed to produce the maximum amount of fuel oil, and this means that as much of the resulting light ends that can be tolerated in the product, will be left in. Usually the limiting factor on light ends is the flash point of the fuel.

Although a blending operation is shown in the drawing, in which cutter stock is blended with heavy fuel oil from line 33, the present process has the great advantage of minimizing the amount of cutter stock required. Blending may be eliminated, in some circumstances, by simply adding the hydrogen-donor and/or cutter stock to the visbreaker feed.

The visbreaker may be integrated with a deasphalting unit, either upstream or downstream of the unit, as described in U.S. Pat. No. 4,428,824 to which reference is made for details of such a combined unit and its operation. When a combination of deasphalting and visbreaking is practiced, it will usually be possible to increase the severity of the visbreaker operation more than could otherwise be tolerated. In some instances, it may be preferable to subject deasphalted oil to conventional visbreaking, operated without hydrogen-donor solvent, while subjecting the asphaltic fraction to hydrogen-donor visbreaking. Alternatively, the process described in U.S. Pat. No. 4,428,824 may be practiced, wherein the only visbreaking that occurs is on deasphalted oil. In this instance, addition of hydrogen-donor solvent to the visbreaker feed (consisting of a deasphalted oil) will permit improved operation.

EXAMPLES

A series of visbreaking experiments on heavy residual stocks was carried out with resid feeds comprising Arab Heavy residual stocks which had been fractionated to two slightly different cut points. Feed properties were as set out in Table 6 below:

TABLE 6

| Arab Heavy Resid | | |
|---|---|---|
| Nominal initial boiling point, °C. | 454 | 496 |
| Viscosity, cSt at | | |
| 100° C. | 1079.4 | 4789.2 |
| 150° C. | 89.6 | 957.4 |
| Pour point, °C. | 38 | 48 |
| APT | 7.4 | 5.9 |
| Specific gravity, 15° C. | 1.0184 | 1.0295 |
| Aromatics sulfur content, weight % | 5.16 | 5.4 |
| CCR, weight % | 16.3 | 18.3 |

Conventional visbreaking of feeds of this kind is generally limited to a severity of about 450 ERT seconds at 427° C. (800° F.) because of sedimentation problems. As will be shown below, however, the present process permits successful operation at higher severities with reduced sedimentation.

The cutter stock used to dilute the product to meet viscosity specifications had the properties given in Table 7 below.

TABLE 7

| Cutter Stock | | |
|---|---|---|
| API | 37.4 | |
| Specific gravity, 15° C. | 0.8377 | |
| ASTM-D86 Distillation, ca | °C. | (°F.) |
| 10% | 245 | (473) |
| 30% | 254 | (490) |
| 50% | 264 | (508) |
| 70% | 285 | (545) |
| 90% | 306 | (582) |
| Kinematic Viscosity (50° C.), cS | 2.70 | |

EXAMPLES 1-4

These experiments were carried out in a laboratory visbreaker, essentially a batch reactor which closely simulated a commercial visbreaker.

In Examples 1 and 2, the 496° C.+ Arab Heavy resid was visbroken at 800 ERT seconds at 427° C. (800° F.) in the presence of 2.5 and 5.0 wt percent the FCC/CSO No. 1 hydrogen donor solvent identified above. After visbreaking, cutter stock was added to reduce viscosity to meet product specifications.

Examples 3 and 4 repeated the visbreaking but without the addition of the CSO prior to visbreaking. In order to compensate for the dilution effect of the CSO, the same amounts were added to the visbroken product, together with the same amounts of cutter stock. Accordingly, the viscosity, pour point and sedimentation results reported in Table 5 below are reported on a consistent basis, i.e. the CSO was added before any of these tests were run. The viscosity and pour point tests were conducted before the cutter stock was added and the sedimentation test afterwards.

The sediment test used was the centrifuge method used to determine the compatibility of sediment in blended marine fuel oil. This method is used to determine the volume percentage of incompatible sediment in blended marine fuel oils.

A 100 ml sample of the blended fuel oil is centrifuged in a heated centrifuge (65.5° C.+1° C.) centrifuged for 3 hours at a relative centrifugal force of 700 units. Further details of the centrifuge operation can be taken from ASTM D-96.

There is another test method commonly referred to as a hot filtration test, which gives weight percentage sediment after hot filtration and washing with normal hexane. A fuel with 1 volume % sediment will usually, but not always, have about 0.5 weight % sediment. All testing reported in this specification uses the hot centrifuge method so results are reported in volume percent sediment.

In the sediment tests reported here, there is no dilution of the sample with virgin gas oil; rather the sample is charged to the centrifuge without dilution.

The results are reported in Table 8 below.

TABLE 8

| CSO Hydrogen Donor Visbreaking | | | | |
|---|---|---|---|---|
| | CSO added before visbreaking | | CSO added after visbreaking | |
| Example | 1 | 2 | 3 | 4 |
| Weight % CSO | 2.5 | 5.0 | 2.5 | 5.0 |
| Hydrogen-donor Viscosity, cSt | 757 | 667 | 6472 | 1619 |

TABLE 8-continued

| | CSO Hydrogen Donor Visbreaking | | | | | | | |
|---|---|---|---|---|---|---|---|---|
| | CSO added before visbreaking | | | | CSO added after visbreaking | | | |
| Example | 1 | | 2 | | 3 | | 4 | |
| at 82° C. Pour Point, °C. (°F.) | 24 | (75) | 18 | (65) | 49 | (120) | 43 | (110) |
| Weight % Cutter Stock added: | 10 | (20) | 10 | (20) | 10 | (20) | 10 | (20) |
| Sediment, volume %* | Tr | Tr | Tr | 3.3 | 0.85 | 16 | 0.9 | 14.5 |

*Tr = trace

The benefits of adding, only 2.5 weight percent FCC of the CSO to the visbreaker feed are evident. The viscosity has been significantly reduced by the addition of only 2.5 weight percent hydrogen-donor to the feed, rather than to the product of the visbreaker.

The pour point of the product has been significantly reduced also: 2.5 weight percent clarified slurry oil reduce the pour point from 49° C. to 24° C. Similar results are obtained with the addition of 5 weight percent CSO, reducing the pour point from 43° C. to 18° C. Even when blended with 20 weight % cutter stock, the visbroken product of the invention had only a trace, or acceptable, amount of sediment. In contrast, the visbroken product obtained without the use of the CSO as an H-donor, produced 14.5 or 16 volume percent sediment after addition of 20 weight % cutter stock.

The advantages of adding 2.5 weight % CSO to the visbreaker feed may be summarized as follows:

(i) lower viscosity (ii) lower pour point (iii) more cutter stock tolerated.

EXAMPLES 5–8

Another series of tests was run using the slightly lighter Arab Heavy resid, having a 454° C. IBP as feed. The H-donor used was the FCC/LCO No. 1 identified in Table 2 above. In these Examples, significantly larger amounts of light cycle oil (LCO) hydrogen-donor were added, namely 10 and 20 weight percent. In these Examples, both the feed and the hydrogen-donor diluent are slightly lighter, or lower in molecular weight, as compared to the feed and hydrogen-donor used in Examples 1–4, reported in Table 8.

The test procedure used, and a visbreaking severity (800 ERT seconds) were identical to those used for the testing reported in Table 5. The results are given in Table 9.

TABLE 9

| | LCO Hydrogen Donor Visbreaking | | | |
|---|---|---|---|---|
| | LCO added before visbreaking | | LCO added after visbreaking | |
| Example | 5 | 6 | 7 | 8 |
| Weight % LCO hydrogen donor | 10 | 20 | 10 | 20 |
| Viscosity, cSt at 54° C. | 189.9 | 79.8 | 259.2 | 110.9 |
| Pour point, | | | | |
| °C. | −7 | −15 | 2 | −1 |
| (°F.) | (20) | (5) | (35) | (30) |
| Sediment, volume % w/15% wt. % cutter stock | 1 | 0.5 | 3 | 5 |

These data show that a significant reduction in the amount of sediment in the visbreaker product after addition of cutter stock can be obtained by the use of the hydrogen donor during the visbreaking.

EXAMPLES 9–10

These Examples compare the results of a conventional visbreaking operation (500 ERT seconds at 427° C., no hydrogen donor) with an H-donor visbreaking operation at higher severity (800 ERT seconds at 427° C.). The feed used was the 454° C.+ Arab Heavy resid. The H-donor used was the FCC/LCO No. 1, above.

The results are given in Table 10 below.

TABLE 10

| | Resid Visbreaking | |
|---|---|---|
| | Ex. 9 Conventional Visbreaking | Ex. 10 H-donor Visbreaking |
| Severity, ERT seconds, 427° C. | 500 | 800 |
| Feed Rate, $m^3$/day | | |
| Resid | 2020 | 2020 |
| H-Donor (LCO) | 0 | 202 |
| Products, weight % | | |
| $C_4$— | 1.58 | 2.3 |
| $C_5$— 149° C. | 3.00 | 4.6 |
| 149° C. + Bottoms | 95.42 | 93.1 |
| Viscosity of 149° C. + Bottoms, cSt at 50° C. | 1560 | 160 |
| Cutter Stock required to make 120 cSt heavy fuel oil, $m^3$/day | 445 | 52 |
| Total Cutter Stock required including H-Donor, $mm^3$/day | 445 | 254 |

Table 10 shows that an increase in visbreaking severity in the presence of 10 weight percent LCO translates into a considerable savings in the cutter stock required to make a 120 cSt (50° C.) fuel oil product. By visbreaking at 800 ERT seconds in the presence of 10 weight percent LCO, a 191 $m^3$/day reduction in cutter stock requirement is achieved, in comparison to conventional visbreaking at 500 ERT seconds.

EXAMPLES 11–14

The 496° C.+ Arab Heavy resid was visbroken at 800 ERT seconds (427° C.) with and without H-donor. The H-donor used in Examples 10 and 11 was the FCC/LCO No. 1 above. To compensate for the dilution effect of the LCO donor, equivalent amounts were added to the visbroken product of Examples 13 and 14 before viscosity and sedimentation tests were made.

The results are given in Table 11 below.

TABLE 11

| | Resid Visbreaking | | | |
|---|---|---|---|---|
| | LCO Added to Visbreaker Feed | | LCO Added to Visbroken Product | |
| Example | 11 | 12 | 13 | 14 |
| Amount LCO Added, weight % | 10 | 20 | 10 | 20 |
| Mixture Viscosity, cSt at 82° C. | 177 | 53.5 | 939 | 246 |
| Sediment, volume % | Trace | Trace | 1.6 | 17.0 |

EXAMPLES 15–16

Additional tests were conducted on a different feedstock, a heavy Nigerian resin feed. The H-donor used in Example 16 was the TCC Distillate No. 1 of Table 2 above (20% by volume, based on feed). No donor was used in Example 15. Feed and cutter stock properties were as set out in Table 12, and test conditions and results are set out in Table 13.

TABLE 12

| Heavy Resid | 510° C. + Nigerian Cutter Stock | |
|---|---|---|
| API Gravity | 10.5 | 24.6 |
| Specific Gravity (15° C.) | 0.9965 | 0.9065 |
| Pour Point, °C. | 38 | −7 |
| °F. | 100 | 20 |
| Viscosity, cSt at 50° C. | — | 2.2 |
| 80° C. | 1859.8 | 1.24 |
| 100° C. | 565.9 | — |
| KV (122° F.) | — | 2.2 |
| KV (180° F.) | 1859.8 | 1.24 |
| KV (212° F.) | 565.9 | — |

| | D1160-1 | | D86 | |
|---|---|---|---|---|
| Distillation, °C. | °F. | °C. | °C. | °F. |
| 5% | 932 | 500 | 189 | 372 |
| 10% | 982 | 528 | 198 | 388 |
| 30% | 1096 | 591 | 231 | 448 |
| 50% | 1108 | 598* | 270 | 518 |
| 70% | | — | 309 | 588 |
| 90% | | | 356 | 672 |
| 95% | | | 373 | 704 |

*(@ 33%)

TABLE 13

| Example | Heavy Nigerian Resid 15 | 16 |
|---|---|---|
| Severity, ERT Seconds | 1200 | 1500 |
| Feed Rate, $m^3$/day | | |
| Resid | 636 | 636 |
| H-Donor (TCC Distillate No. 1) | 0 | 127 |
| Product Yields, weight % ($m^3$/day) | Wt. % $m^3$/d | Wt. % $m^3$/d |
| $C_4$— | 1.7 | 2.0 |
| Naphtha ($C_5$— 166° C.) | 4.8 (41) | 5.3 (47) |
| Distillate (166–343° C.) | 11.2 (80) | 27.6 (223) |
| Bottoms (343° C.+) | 82.4 (512) | 65.2 (483) |
| Viscosity of bottoms, cSt at 50° C. | 15687 | 12456 |
| Cutter Stock required for 120 cSt product, $m^3$/day | 244 | 222 |
| Overall yields, $m^3$/day | | |
| Naphtha | 41 | 47 |
| Distillate | (164) | (126) |
| Comparison, $m^3$/day | | |
| Naphtha | BASE | 6 |
| Distillate | " | 38 |

NOTE:
In both cases, the viscosity of the bottoms (343° C.+) increased at higher severity.

EXAMPLES 17–18

A commercial visbreaker feed was subjected to visbreaking with and without a hydrogen donor. The conditions used and results obtained are given in Table 14 below.

TABLE 14

| | Ex. 17 Base | Ex. 18 H-Donor |
|---|---|---|
| Severity, ERT Seconds | 630 | 800 |
| Feed Rate, $m^3$/day | | |
| Resid | 1294 | 1294 |
| H-Donor (FCC LCO) | 0 | 94 |
| Product Yield, weight % | | |
| $C_4$— | 5.8 | 6.0 |
| $C_5$— 132° C. | 2.7 | 4.4 |
| 132° C. + Bottoms | 91.5 | 89.6 |
| 132° C. + Properties: | | |
| Kinematic Viscosity, cSt at 50° C. | 2739 | 819 |
| Specific Gravity at 15° C. | 1.0184 | 1.0115 |
| Cutter Stock required for 150 cSt product, $m^3$/day | 532 | 352 |
| Total Cutter Stock including H-Donor, $m^3$/day | 532 | 446 |
| Comparison, $m^3$/day | BASE | (86) |

It can be seen from the data in Table 14 that the H-donor visbreaking process results in a substantial savings in reducing the amount of cutter stock required to make a saleable product. In the examples shown, the cutter stock savings was 86 $m^3$/day. The savings represents the difference in value between the premium quality cutter stock and the much lower valued heavy fuel oil product.

EXAMPLES 19–21

A series of tests were carried out to demonstrate the significance of proton content and distribution in the donor solvent. The solvents used were two FCC/CSO oils of differing compositions and a TCC bottoms fractions. The proton analyses of these oils is given, together with others in Table 15 below.

TABLE 15

| | H Donor Proton Analysis | | | | |
|---|---|---|---|---|---|
| | $H_{alpha}$ | | $H_{Ar}$ | | H Total |
| | % H | (% Solv) | % H | (% Solv) | % Solv |
| FCC/CSO | | | | | |
| No. 4 | 34.0 | 2.43 | 32.9 | 2.35 | 7.15 |
| No. 5 | 23.7 | 1.68 | 38.1 | 2.69 | 7.07 |
| No. 6 | 30.3 | 2.17 | 35.0 | 2.51 | 7.17 |
| FCC/LCO No. 4 | 22.2 | 2.15 | 19.6 | 1.91 | 9.7 |
| TCC/BTTM No. 4 | 18.2 | 1.70 | 22.7 | 2.12 | 9.34 |
| Hydrotreated CSO No. 5 | 29.83 | 2.39 | — | — | 8.01 |

The donor solvents used in these tests were FCC/CSO Nos. 4 and 5 and the TCC/BTTM.

Each solvent was mixed with the heavier (496° C.+, 925° F.+) Arab Heavy resid (2.5 wt. percent solvent) and visbroken at 800 ERT seconds (427° C., 800° F.). After visbreaking, light fuel oil (LFO) was added as cutter stock. Comparison data was obtained, as described above, by adding the solvent to the visbroken resid after visbreaking to compensate for the dilution effect of the solvent. In each case, the volume percentage of sediment was determined. The results are given in Table 16 below.

TABLE 16

| | Effect of Donor Proton Distribution | |
|---|---|---|
| | Sediment, vol % | |
| Wt % LFO | CSO Added Before Visbreak | CSO Added After Visbreak |
| Ex. 19, CSO No. 4 | | |
| 10 | 0.05 | 0.85, 0.85 |
| 16 | 0.05 | — |
| 20 | 0.6, 1.0 | 15.0, 17.0 |
| Ex. 20, CSO No. 5 | | |
| 10 | 0.2, 0.25 | — |
| 20 | 17.0, 16.0 | — |
| 30 | 32.0, 30.0 | — |

TABLE 16-continued

Effect of Donor Proton Distribution

| Wt % LFO | Sediment, vol % CSO Added Before Visbreak | Sediment, vol % CSO Added After Visbreak |
|---|---|---|
| 40 | 29.0, 27.0 | — |
| Ex. 21, TCC/BTTM | | |
| 10 | 7.0 | — |
| 20 | 26.0 | — |
| 30 | 32.0 | — |

Note:
CSO runs duplicated, both results given

The results in Table 16 show that the proton content and distribution of the H-donor is significant in its performance. Although the TCC bottoms fraction has a higher absolute hydrogen content than either of the slurry oils, it has a lower alpha proton and aromatic proton content and performs unsatisfactorily in this process. CSO No. 5 has relatively good performance as a donor but is inferior to CSO No. 4 which has higher alpha and aromatic proton contents, both as a proportion of its total hydrogen content and as a proportion of the entire solvent.

EXAMPLE 22

In order to ensure that catalyst fines entrained in the FCC/CSO No. 4 were not affecting the results of Example 19, the slurry oil was filtered and the donor visbreaking run repeated. The results are given in Table 17 below.

TABLE 17

Effect of CSO Filtration

| Wt % LFO | With Filter | Without Filter |
|---|---|---|
| 20 | 0.8 | 0.6, 1.0 |
| 30 | 0.3* | 0.6, 1.0 |
| 40 | 26 | 0.6, 1.0 |

*Less than

These results establish (cf. Ex. 19) that any entrained catalyst fines do not play a significant role in the process.

EXAMPLES 23-30

The effect of donor proton content and distribution was further shown by comparison of the results obtained by visbreaking the heavier (496° C.+, 925° F.+) Arab Heavy resid at 800 ERT seconds (427° C., 800° F.), using 2.0 or 2.5 weight percent of the donor. The sediment was determined after mixing with 20 weight percent cutter stock (204°-345° C., 400°-650° F., Arab Light stock). The selected donor was added both before and after visbreaking to compensate for its dilution effect, as before. The results are given in Table 18 below. These results indicate that the alpha proton content is of importance in the selection of the donor.

TABLE 18

Effect of Donor Proton Distribution

| Ex. | H-Donor Type | H-Donor Amt. | H-Donor $H_{alpha}$ | Cutter In Blend Wt % | Sediment, Vol % Donor Premixed | Sediment, Vol % Donor Postmixed |
|---|---|---|---|---|---|---|
| 23 | None | — | — | 20 | 29.0 | 29.0 |
| 24 | CSO No. 4 | 2.5 | 2.43 | " | 0.8 | 16.0 |
| 25 | CSO No. 4 (filtered) | 2.5 | " | " | 0.8 | — |
| 26 | CSO No. 5 | 2.5 | 1.68 | " | 16.5 | 20.0 |
| 27 | CSO No. 5 (HDT) | 2.5 | 2.39 | " | 0.05 | 20.0 |
| 28 | CSO No. 6 | 2.5 | 2.14 | " | 2.2 | — |
| 29 | TCC BTTM No. 4 | 2.5 | 1.69 | " | 26.0 | 20.0 |
| 30 | LCO No. 1 | 2.0 | 2.07 | 0 | 0.05 | 17.0 |

EXAMPLE 31

Additional tests were conducted on a commercially sized unit.

The base case was a conventional visbreaking run, which operated for about fifty days. In the base case, the visbreaking unit was operated at a 350 ERT severity for sixty days. The minimum feed rate was 1290 $m^3$/day, with an average feed rate of 1570 $m^3$/day, and a maximum feed rate of 2009 $m^3$/day. The furnace pressure drop, at the start of cycle was 250 kPa, with an average pressure drop of 968 kPa. The end of cycle pressure drop was 1600 kPa.

In the tests of the present process, the minimum feed rate was 1409 $m^3$/day, while the average feed rate was 1675 $m^3$/day, with a maximum feed rate of 1894 $m^3$/day, these feed rates including about 6 wt. percent hydroaromatic solvent, in this case a light cycle oil very similar to the FCC/LCO No. 2, above. Operating conditions were significantly more severe: average reaction severity was maintained at about 600 ERT compared to 350 ERT in the base case run.

Because these were tests conducted on a commercial unit, there were significant variations that occurred in feed rate, feed composition, and other operating variables during the runs. After making customary adjustments for all of the many changes that occurred in both the base and the present invention test runs, it was possible to plot the pressure drop across the furnace for each operation. Operation continued until the pressure drop across the furnace became excessive.

The pressure drop plotted against days on stream produced a plot with a moderate amount of scatter. The present process had a significantly lower pressure drop, both at the start and at the end of the run as compared to the conventional operation.

After about fifty days of operation, operation of the visbreaker in the conventional manner resulted in approximately 22 percent higher pressure drop as compared to the present visbreaking process, which was operated at a significantly higher severity. The significance of the lower pressure drop is that the run length of the visbreaker may be significantly extended. For example, if a decision is made to terminate the run at some arbitrary pressure drop, e.g., 1200 kPa, the conventional visbreaking operation must be shut down after about 26-27 days on stream. The present process, operating at a significantly higher severity, does not reach an equivalent pressure drop until about 47 days on stream. Thus the present process permits visbreakers to be run at increased severity, and permits them to be run for much longer periods of time at increased severity. This increased run length is a benefit of the present invention which is in addition to the ability to operate at higher ERT severities.

We claim:

1. A process for visbreaking a heavy petroleum residual oil in which the oil is subjected to visbreaking at an equivalent reaction time, ERT, of less than or equal to about 800 seconds at 800° F. in the absence of added free hydrogen and in the presence of about 0.1 to 50 weight percent of a highly aromatic hydrogen donor material characterized by its hydrogen content distribution, in $H_{Ar}$ and $H_{alpha}$ are each at least 20 percent of the total hydrogen content of the donor, to produce a visbroken oil product having reduced viscosity.

2. A process according to claim 1 in which the $H_{Ar}$ and $H_{alpha}$ proton contents of the donor are from 20 to 50 percent each of the total hydrogen content of the donor.

3. A process according to claim 2 in which the donor solvent has an $H_{Ar}$ content of at least 2.0 weight percent of the donor and an $H_{alpha}$ content of at least 1.9 weight percent of the donor.

4. A process according to claim 1 in which the amount of the donor is from 1 to 20 weight percent of the heavy residual oil.

5. A process according to claim 1 in which the donor comprises a fraction produced by the catalytic cracking of petroleum.

6. A process according to claim 5 in which the hydrogen donor is a clarified slurry oil, a cycle oil, or a main column bottoms fraction obtained from the fluid catalytic cracking of petroleum of a TCC syntower bottoms fraction.

7. A process according to claim 1 in which the donor comprises a hydrocarbon obtained from a non-petroleum source.

8. A process according to claim 1 in which the visbreaking is carried out at a severity from 500 to 800 ERT seconds at 800° F.

9. A process according to claim 1 in which the visbreaking is carried out at a temperature from 350° to 485° C. with a residence time of 1 to 60 minutes.

10. A process according to claim 9 in which the visbreaking is carried out at a temperature from 425° to 455° C. with a residence time of 7 to 20 minutes.

11. In a process for visbreaking a heavy petroleum residual oil, the improvement comprising visbreaking the oil in the presence of 0.1 to 50 weight percent, based on the heavy oil, of a non-hydrotreated hydrogen donor solvent derived from a thermal or fluidized catalytic cracking process and in the absence of added free hydrogen and the hydrogen donor material being characterized by a hydrogen content distribution, in which $H_{Ar}$ and $H_{alpha}$ are each at least 20 percent of the total hydrogen content of the hydrogen donor material.

12. A process according to claim 11 in which the visbreaking is carried out at a severity of up to 800 seconds ERT at 800° F.

13. A process according to claim 12 in which the visbreaking severity is from about 500 to 800 ERT seconds.

14. A process according to claim 11 in which the amount of the hydrogen donor is from 0.1 to 20 weight percent of the heavy oil.

15. A process according to claim 11 in which the $H_{Ar}$ and $H_{alpha}$ content of the hydrogen donor are from 20 to 50 percent each of the total hydrogen content.

16. A process for visbreaking a heavy petroleum residual oil which comprises subjecting the oil to an elevated temperature for a period of time corresponding to an equivalent reaction time of 250 to 1500 ERT seconds at 800° F., in the absence of added free hydrogen and in the presence of from 0.1 to 50 weight percent, based on the residual oil, of a hydro-aromatic hydrogen donor solvent having a content of $H_{Ar}$ and $H_{alpha}$ each of at least 20 percent of the total hydrogen content of the solvent, and recovering a fuel oil product having a viscosity lower than that of the starting residual oil.

17. A process according to claim 16, in which the visbreaking is carried out at 400 to 1200 ERT seconds at 800° F.

18. A process according to claim 17, in which the visbreaking is carried out at 500 to 800 ERT seconds.

19. A process according to claim 1, in which the visbreaking is carried out at 350° to 485° C. for 1 to 60 minutes.

20. A process according to claim 19 in which the visbreaking is carried out at 425° to 455° C. for 7 to 20 minutes.

21. A process according to claim 16 in which the visbreaking is carried out in the presence of 0.1 to 20 weight percent, based on the residual oil, of the hydro-aromatic solvent.

22. A process according to claim 21 in which the amount of hydro-aromatic solvent is 10 to 20 weight percent, based on the residual oil.

23. A process according to claim 16 in which the hydro-aromatic solvent has a $H_{Ar}$ content from 20 to 50% and a $H_{alpha}$ content from 20 to 50%, based on total hydrogen content of the hydro-aromatic solvent.

24. A process according to claim 23 in which the hydro-aromatic solvent has a $H_{Ar}$ content of at least 2.0 weight percent and a $H_{alpha}$ of at least 1.9 weight percent, based on the solvent.

25. A process according to claim 16 in which the hydro-aromatic solvent is a non-hydrotreated solvent derived from the catalytic cracking of a petroleum oil.

26. A process according to claim 25 in which the hydro-aromatic solvent is selected from FCC main column bottoms, TCC syntower bottoms, clarified slurry oil and light cycle oil.

27. A process according to claim 26 in which the hydro-aromatic solvent is FCC light cycle oil or TCC light cycle oil.

28. A process according to claim 16 in which the hydroaromatic solvent is a non-petroleum material.

29. A process according to claim 28 in which the hydroaromatic solvent comprises coal liquids.

30. A process according to claim 29 in which the coal liquids comprises SRC recycle oil.

31. A process for thermal cracking a heavy oil which comprises subjecting the oil to an elevated temperature for a period of time corresponding to an equivalent reaction time of 1500 to 15,000 ERT seconds at 427° C., in the absence of added free hydrogen and in the presence of from 0.1 to 50 weight percent, based on the heavy oil, of a non-hydrotreated solvent derived from the cracking of a petroleum oil, which has a content of $H_{Ar}$ and $H_{alpha}$ hydrogen each of at least 20 percent of the total hydrogen content of the solvent and recovering lighter products from the reaction mixture.

32. A process according to claim 31 in which the solvent has an $H_{Ar}$ and $H_{alpha}$ content of 20 to 50 percent each of the total hydrogen content of the solvent.

33. A process according to claim 31 in which the $H_{Ar}$ content of the solvent is at least 2.0 weight percent and the $H_{alpha}$ content of the solvent is at least 1.9 weight percent, based on the solvent.

34. A process according to claim 31 in which the amount of the solvent is from 0.1 to 20 weight percent of the heavy oil.

35. A process according to claim 31 in which the solvent comprises a hydrocarbon fraction produced by the catalytic cracking of a petroleum oil.

* * * * *

UNITED STATES PATENT AND TRADEMARK OFFICE

CERTIFICATE OF CORRECTION

PATENT NO. : 4,615,791

DATED : Oct. 7, 1986

INVENTOR(S) : Choi et al

It is certified that error appears in the above-identified patent and that said Letters Patent is hereby corrected as shown below:

| | |
|---|---|
| Col. 6, line 60 | "cyclc" should read --cycle--. |
| Col. 8, line 11 | "As" should read --An--. |
| Col. 10, line 11 | "of" should read --or--. |
| Col. 14, line 45 | "+" should read — ± —. |

Signed and Sealed this

Tenth Day of November, 1987

*Attest:*

*Attesting Officer*

DONALD J. QUIGG

*Commissioner of Patents and Trademarks*